US006882596B2

(12) United States Patent
Guanter et al.

(10) Patent No.: US 6,882,596 B2
(45) Date of Patent: Apr. 19, 2005

(54) MANUAL CONTROL DEVICE FOR EXECUTING FUNCTIONS OF AN ELECTRONIC WATCH

(75) Inventors: Jean-Charles Guanter, Diesse (CH); Gian-Carlo Poli, Les Geneveys-sur-Coffrane (CH)

(73) Assignee: Asulab S.A., Marin (CH)

( * ) Notice: Subject to any disclaimer, the term of this patent is extended or adjusted under 35 U.S.C. 154(b) by 72 days.

(21) Appl. No.: 10/329,674

(22) Filed: Dec. 27, 2002

(65) Prior Publication Data

US 2003/0123329 A1 Jul. 3, 2003

(30) Foreign Application Priority Data

Dec. 27, 2001 (CH) ..... 2373/01

(51) Int. Cl.[7] ..... G04C 17/00

(52) U.S. Cl. ..... 368/64; 368/84; 368/230; 368/242

(58) Field of Search ..... 368/20, 41–43, 368/69, 84, 230, 244; 345/173

(56) References Cited

U.S. PATENT DOCUMENTS

| | | | | | |
|---|---|---|---|---|---|
| 3,983,690 | A | * | 10/1976 | McClintock | 368/69 |
| 4,139,837 | A | * | 2/1979 | Liljenwall et al. | 382/189 |
| 4,228,534 | A | * | 10/1980 | Fellrath et al. | 368/224 |
| 4,257,117 | A | * | 3/1981 | Besson | 368/69 |
| 4,385,291 | A | * | 5/1983 | Piguet | 345/173 |
| 5,012,124 | A | * | 4/1991 | Hollaway | 307/116 |
| 5,088,070 | A | | 2/1992 | Shiff | |
| 5,453,960 | A | * | 9/1995 | Teres et al. | 368/69 |
| 5,528,559 | A | | 6/1996 | Lucas | |
| 5,742,564 | A | * | 4/1998 | Kuschel et al. | 368/69 |
| 5,940,349 | A | * | 8/1999 | Stewart | 368/69 |
| 6,728,166 | B1 | * | 4/2004 | Grupp | 368/69 |
| 2002/0118605 | A1 | * | 8/2002 | Born et al. | 368/69 |

FOREIGN PATENT DOCUMENTS

| | | |
|---|---|---|
| EP | 0 838 737 A1 | 4/1998 |
| EP | 1 079 325 A1 | 2/2001 |

* cited by examiner

*Primary Examiner*—Kamand Cuneo
*Assistant Examiner*—Jeanne-Marguerite Goodwin
(74) *Attorney, Agent, or Firm*—Sughrue Mion, PLLC

(57) ABSTRACT

The manual control device for executing functions of an electronic watch (1) particularly a diary watch, includes a certain number of sensors (C1 to C7) wherein one touch sensitive pad of each sensor is placed for example on an internal face of the crystal (4). When a user's finger (20) is placed on the watch crystal in a determined zone of the sensitive pad of a sensor to be activated, it causes an electronic circuit (14) of the device to execute an instruction or a function. In a first mode selected by the electronic circuit, at least two sensors are grouped such that the electronic circuit executes the same operation when a finger is placed on the crystal in a determined zone of the sensitive pad of one sensor or the other. However, in a second mode selected by the electronic circuit, each sensor (C1 to C7) activated by the finger (20) provides measuring signals to the electronic circuit (14) for the execution of a different specific operation for each sensor.

The sensitive pads of the sensors are distributed on the internal face of the crystal for the purpose of allowing data to be entered into the watch, pre-stored data to be consulted or different function menus to be consulted.

16 Claims, 5 Drawing Sheets

MANUAL CONTROL DEVICE FOR EXECUTING FUNCTIONS OF AN ELECTRONIC WATCH

BACKGROUND OF THE INVENTION

The invention concerns a manual control device for executing functions, particularly of an electronic watch. The watch may be, for example, an analogue watch that includes, in a case closed by a crystal, a watch movement powered by an energy source, a dial and hands for indicating the time, and at least one liquid crystal display for displaying data. The device includes a determined number of sensors, one touch sensitive pad of each sensor being arranged on an internal or external face of the watch crystal. In order to control the execution of functions, each sensor can be activated by a user's finger placed on the crystal in a determined zone of the corresponding sensitive pad of the sensor. An electronic circuit receives the signals from each sensor to carry out the specific instruction of an activated sensor.

The invention also concerns an electronic watch which includes such a manual control device for executing functions.

The execution of functions of the watch concerns for example data entry, particularly for composing notes, addresses for an address book, for diary meetings, or for adjusting the time and the date. Moreover, it may also concern functions for modifying or removing stored data, for consulting various menus or stored data, time slots to be programmed, alarms or wireless data transmission.

Within this horological field, multiple embodiments of devices with touch sensitive glass of the capacitive or resistive type have already been proposed, particularly for data entry. Patent Document No. EP 0 791 868 in the name of the Applicant, which concerns a data entry device for an electronic watch, may be cited in this respect. The device includes a keyboard with keys each associated with a sensitive pad of a capacitive type sensor, which is arranged on an inner face of the crystal. Each sensor is intended to control the entry of an item of data associated with the corresponding key when a user's finger is placed on the crystal in a determined zone of the sensitive pad of the sensor to be activated. The transparent sensitive pads of the sensors are distributed inside a contour which is delimited by the watch crystal, for example twenty or so sensitive pads. They can form two crowns and a sensitive pad at the centre.

Since the number of sensitive pads is relatively large, it is proposed to offset the sensitive pads towards the bottom of the crystal in order to correct the visual perception of the user when he wishes to place a finger on a determined sensor. In order to do this, the sensitive pads of an upper part are larger than the sensitive pads of a lower part of the watch crystal.

One drawback of the solution described in European Patent document No. 0 791 868 is that it is difficult to place a finger on a single sensitive pad of a sensor to be activated without influencing neighbouring pads, since a large number of sensitive pads are distributed on the inner face of the crystal. The sensitive pads are not in direct contact with each other, but are separated by a short distance much smaller than the dimension of each pad. Thus, even when the sensitive pads on the crystal are offset, manipulation of such a device requires certain dexterity, which makes data entry difficult.

Another drawback of the solution described in this European Patent document is that each sensor is only intended to enter a single data item namely one character, one figure, one symbol or one operator, which limits the field of application of such a device.

In European Patent document No. 0 838 737, device for identifying a manual action on a surface of a watch crystal is disclosed. Several capacitive type sensors each having a transparent sensitive pad arranged on an inner face of the crystal are used. All the sensitive pads are close to each other and distributed along two crowns and a sensitive pad at the centre. This sensor arrangement, connected to an electronic circuit, allows recognition of a character or a symbol drawn by a finger on the surface of the crystal.

As for the preceding document, one drawback of the solution described in European Patent document No. 0 838 737 is that a significant number of sensitive pads separated by a short distance is arranged on the inner face of the crystal. This means that the device has to be provided with a high-performance electronic circuit intended to detect the sensor having the largest capacitive value from among all the sensors capable of being activated by a user's finger. Consequently, the capacitive value of each sensor has to be measured precisely so as to recognise the character drawn by the finger on the crystal.

It is to be noted that, unlike the present invention, the device for identifying a manual action of this document is not used for executing various functions controlled by the activation of at least one sensor of the set of sensors.

SUMMARY OF THE INVENTION

The main object of the invention is thus to overcome the drawbacks of the prior art by proposing a manual control device for executing functions that is easy to handle using a reduced number of sensors. This device with a reduced number of touch sensitive sensors can be used for example for editing or consulting various records of an electronic diary integrated in an electronic watch.

The invention therefore concerns a manual control device for executing functions, particularly for an electronic watch of type cited hereinbefore, wherein, in a first mode selected by the electronic circuit, at least two sensors are grouped such that the electronic circuit executes the same operation when a finger is placed on the crystal in a determined zone of the sensitive pad of one sensor or the other, whereas in a second mode selected by the electronic circuit, each sensor activated by the finger provides measuring signals to the electronic circuit for the execution of a different specific operation for each sensor.

One advantage of the manual control device for executing functions, according to the invention, is that it includes a reduced number of sensors, for example less than 10, whose sensitive pads are arranged on the inner or outer face of the watch crystal. These sensitive pads are arranged to allow a user to control the execution of functions easily and intuitively. With this reduced number of sensors, the sensitive pads are for example each separated by a distance greater than or equal to the dimension of a sensitive pad. Thus, it is possible to place one's finger on a sensitive pad of a single sensor without influencing other neighbouring sensors, which can facilitate processing of the signals in the electronic circuit. Moreover, markings can be provided arranged on the inner face of the crystal to indicate the position of each transparent sensitive pad of the sensors, and to represent, in particular, a specific function of each sensor. The sensors can be of the capacitive or resistive type.

Another advantage of the control device, according to the invention, is that at least two sensors can be grouped by the electronic circuit to execute the same operation or function. Grouping the sensors in pairs may prove useful for facilitating selection of a menu in a mode determined by the electronic circuit.

In the case of a diary watch for example, seven sensors can be available for controlling, programming, editing functions or a function for consulting stored data. During consultation of stored data or selection of a menu, four sensors can be grouped in pairs so as to leave only five sensitive sensor pads for executing specific functions. However, in an editing mode for composing various records using sets of characters, the two pairs of sensors are separated of each of the seven sensors to allow execution of a specific function.

It is to be noted that for the diary watch, the device can be used to complete the record fields of notes, addresses, a diary or settings or parameters. A field can include for example up to 63 alphanumerical characters. Consequently, with the seven sensors available, it is possible to easily input a large number of fields to store of each type of records. For example, close to 2,000 note or diary records.

Since the liquid crystal display(s) are preferably located in a central part of the watch dial, the various sensitive pads to be activated for consulting and editing records are arranged at the periphery of the crystal. Thus, it is possible to display all the data displayed on the display(s) during activation of the external sensitive pads by a user's finger. A sensitive pad of a sensor is however located at the centre of the crystal so as to be used particularly for selecting menus and validating data entry, and for controlling the electronic circuit in order to separate the pairs of sensors in an editing mode.

The invention also concerns a watch wherein the liquid crystal display and the sensitive pads of the sensors are arranged so as to make data displayed on the display visible when certain sensors are activated by a user's finger.

BRIEF DESCRIPTION OF THE DRAWINGS

The objects, advantages and features of the manual control device for executing functions particularly of an electronic watch will appear more clearly in the following description of at least one embodiment illustrated by the drawings, in which.

DETAILED DESCRIPTION OF THE INVENTION

The following description relates to a manual control device for executing functions of an electronic diary watch of the analogue type. However, the use of such a device is of course not limited to this type of watch, but can be used for any electronic watch having, for example, at least one liquid crystal display for displaying entered or stored data.

Figure 1:
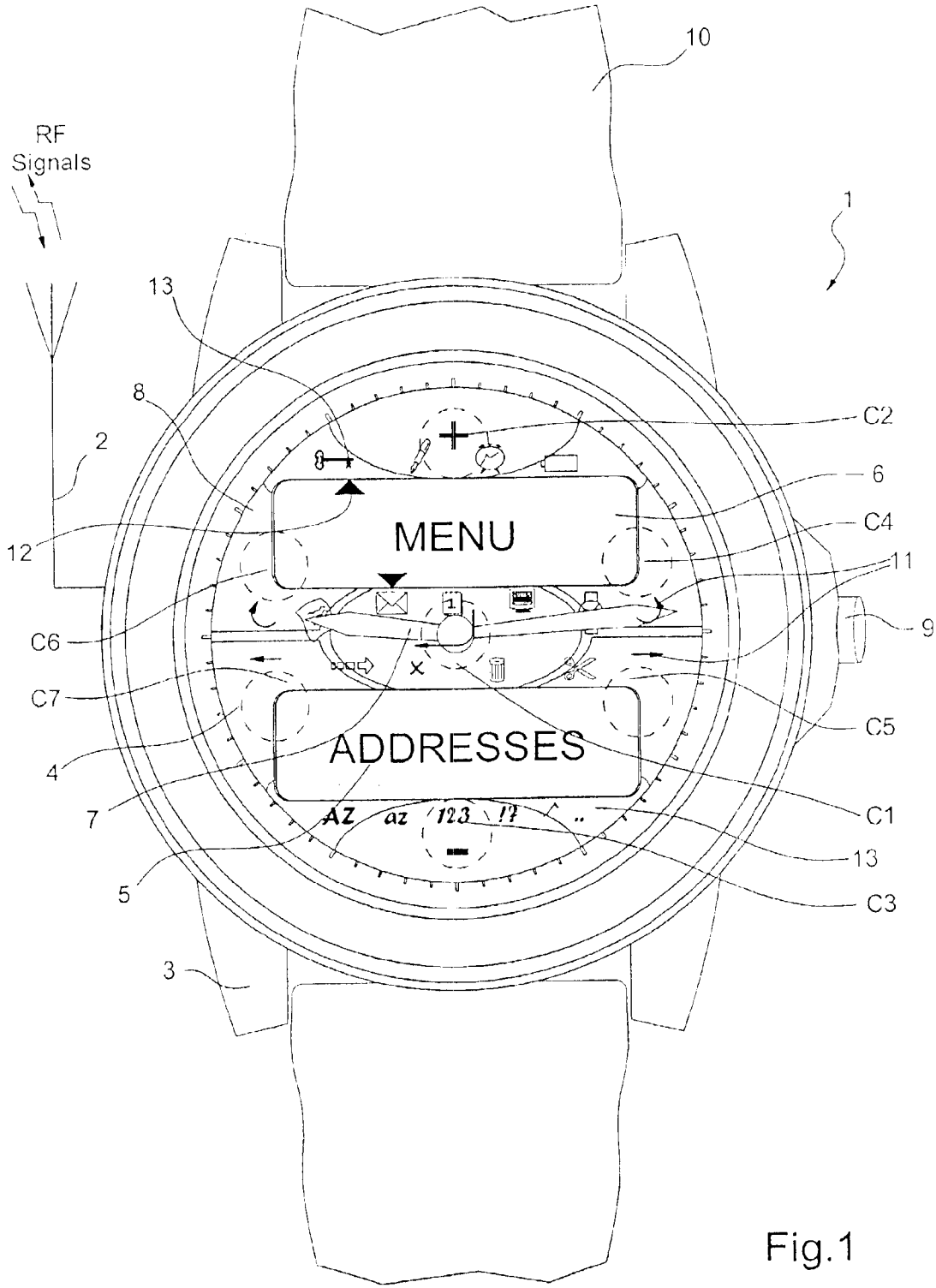
FIG. 1 shows a top view of an electronic watch with analogue time display, provided with a manual control device according to the invention.
Figure 2:
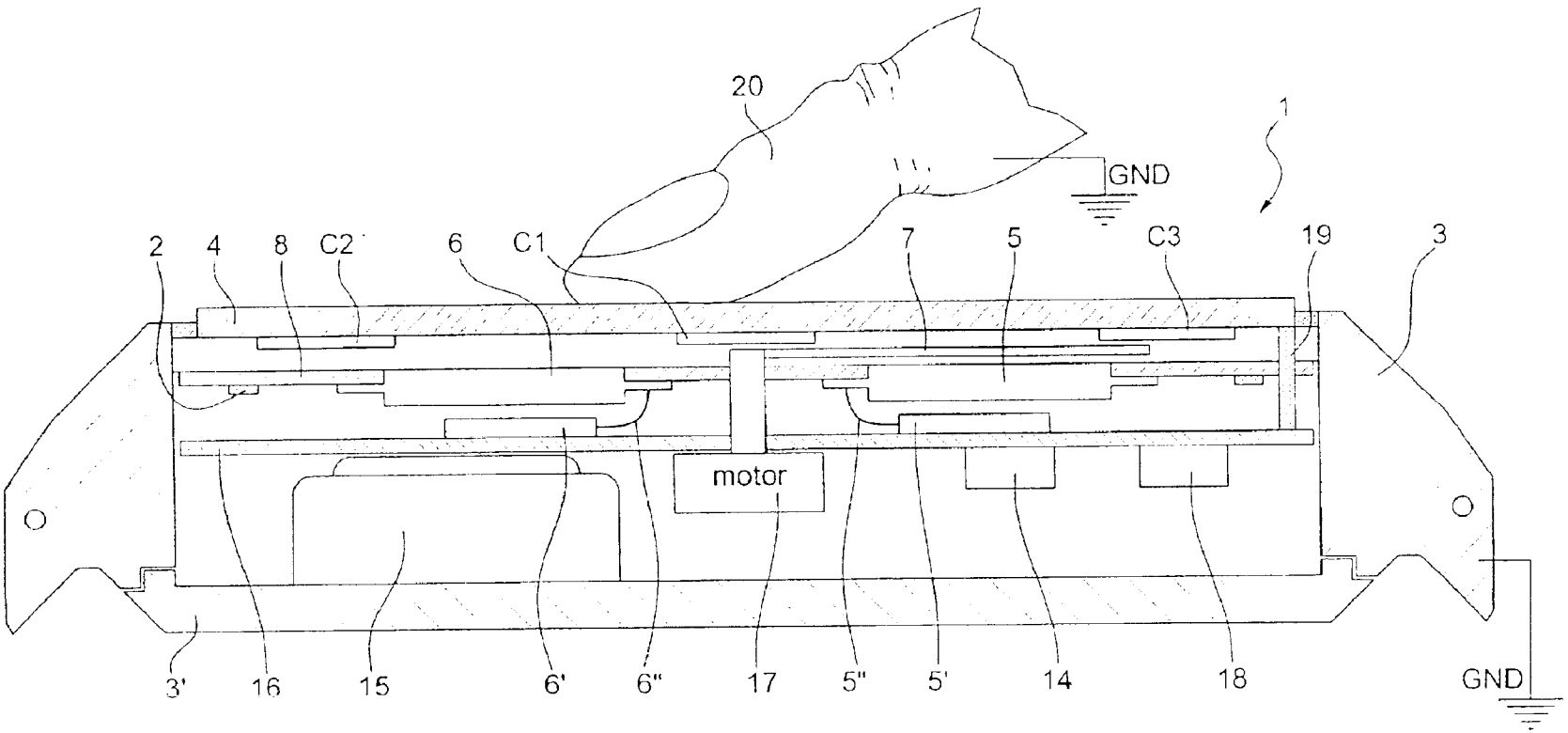
FIG. 2 shows a cross-section of the watch shown in FIG. 1.

In the embodiment shown in FIGS. 1 and 2, the diary watch includes a case, defined by a middle part 3 incorporating a bezel and a back cover 3', a crystal 4 closing the case, a wristband 10 attached to the case, and switch-on means, such as a push-button 9 able to be used to activate the manual control device. The crystal may be a scratchproof sapphire crystal. The case houses a watch movement 17, powered by an energy source such as a battery 15 or accumulator, which drives hands 7 above a dial 8 to indicate the time, and two liquid crystal displays 5 and 6 of the matrix type for displaying data. The energy source can be formed, for example, of two silver oxide batteries series-connected, each at 1.55 V, for example of the RENATA 350 type.

The two liquid crystal displays 5 and 6, having a substantially rectangular display surface, are preferably of equivalent dimensions. These displays 5 and 6 are fixed to the back of dial 8 and appear in two apertures in dial 8 located above and below the shafts carrying hands 7. The two displays are mainly used to display data or various menus when the manual control device is in an operating mode. The data or menus are displayed in a perpendicular direction to the length of wristband 10.

In case 3 and under dial 8, the diary watch also includes a printed circuit board 16. There are mounted on this board 16 two drive devices 5' and 6' for the displays, each connected by a flexible conductive path strip 5" and 6" to each display 5 and 6, motor 17 of the watch movement, electronic measuring signal processing circuit 14 of the manual control device, and an RF module 18. In the embodiment shown in FIG. 2, the positive pole of battery 15 or the accumulator is connected to a positive supply terminal of printed circuit board 16, whereas the negative pole GND of battery 15 is connected to the back cover 3' of the metallic case. However, it would be possible to envisage connecting the negative pole of the battery to the supply terminal of board 16, and the positive pole to back cover 3' of the case.

RF module 18 is connected by a connector 19 to an antenna 2 for transmitting and/or receiving radiofrequency signals. Communication can be established, for example, with a computer station or another watch not shown, for two-directional transmission of diary data signals. Since the case is made of metallic material in this embodiment, antenna 2 is preferably placed under dial 8 at its periphery. For transmission in the ISN band at 433.9 MHz for example, the antenna is formed of a single circular turn defining a circle of the largest possible diameter, in order to have the maximum possible gain in the given space of the watch.

Transmission at different frequencies, for example up to a frequency of 2.45 GHz is of course also possible and the shape of the antenna will have to be adapted to the requirements of the frequency used.

Icons 13, representative of a menu, an operation or programming to be carried out, are arranged on dial 8 around each liquid crystal display 5 and 6. The icons placed above first display 6 represent, for example, data confidentiality, an editing mode, alarms and the state of the battery. The icons placed below first display 6 represent, for example, menus of notes, addresses, diary, transmission and settings. The icons placed above second display 5 represent, for example, editing, data entry cancelling, data deletion or character insertion operations. Finally, the icons placed below second display 5 represent, for example, in an editing mode, upper case characters, lower case characters, figures, symbols or accents.

Electronic circuit 14 is intended to send control signals to each drive device 5' and 6' so that at least one pointer 12 on one or the other of displays 5 and 6 appears designating an icon of the menu, operation or programme selected.

The manual control device for executing functions, according to the invention, includes several capacitive type sensors C1 to C7. The transparent sensitive pads of the sensors are arranged on an inner face of crystal 4. The number of sensitive pads is preferably equal to seven for executing, in particular, all the diary functions as explained hereinafter with reference particularly to FIGS. 4*a* and 4*b*. The touch sensitive pads are represented in FIG. 1 by circles in dotted lines. Moreover, marks 11 are placed on the inner face of crystal 4 so as to indicate the position of each sensitive pad, as well as a function of each sensor C1 to C7.

A sensitive pad of a first sensor C1 is placed at the centre of crystal 4. Two second sensors C2, C3 have their sensitive pad arranged at the periphery of the crystal respectively at 12 o'clock and 6 o'clock. Two third sensors C4, C5 have their sensitive pad arranged at the periphery of the crystal around the 3 o'clock indication. Finally, two fourth sensors C6, C7 have their sensitive pad arranged at the periphery of the crystal around the 9 o'clock indication. This distribution of the sensors allows the execution of various functions to be easily and intuitively controlled.

As will be explained hereinafter, in a first mode selected by electronic circuit 14, the third and fourth sensors C4 to C7 are grouped in pairs so as to have sensor activation zones located at the centre, at 3 o'clock, 6 o'clock, 9 o'clock and 12 o'clock. In this first selected mode, it is possible to execute the functions of selecting or consulting menus or various diary records when the sensors are activated by a user's finger. However, in a second mode selected by electronic circuit 14, the pairs of sensors are separated such that each sensor controls a different specific function from electronic circuit 14 when they are activated.

Each sensitive pad is a circular electrode of the same dimension. All of sensitive pads C1 to C7 are separated by a distance greater than or equal to the diameter of each electrode. Thus, a user's finger 20 can be placed on crystal 4 in a determined zone of a sensitive pad of a single sensor to be activated without influencing the other neighbouring sensors.

Figure 3:
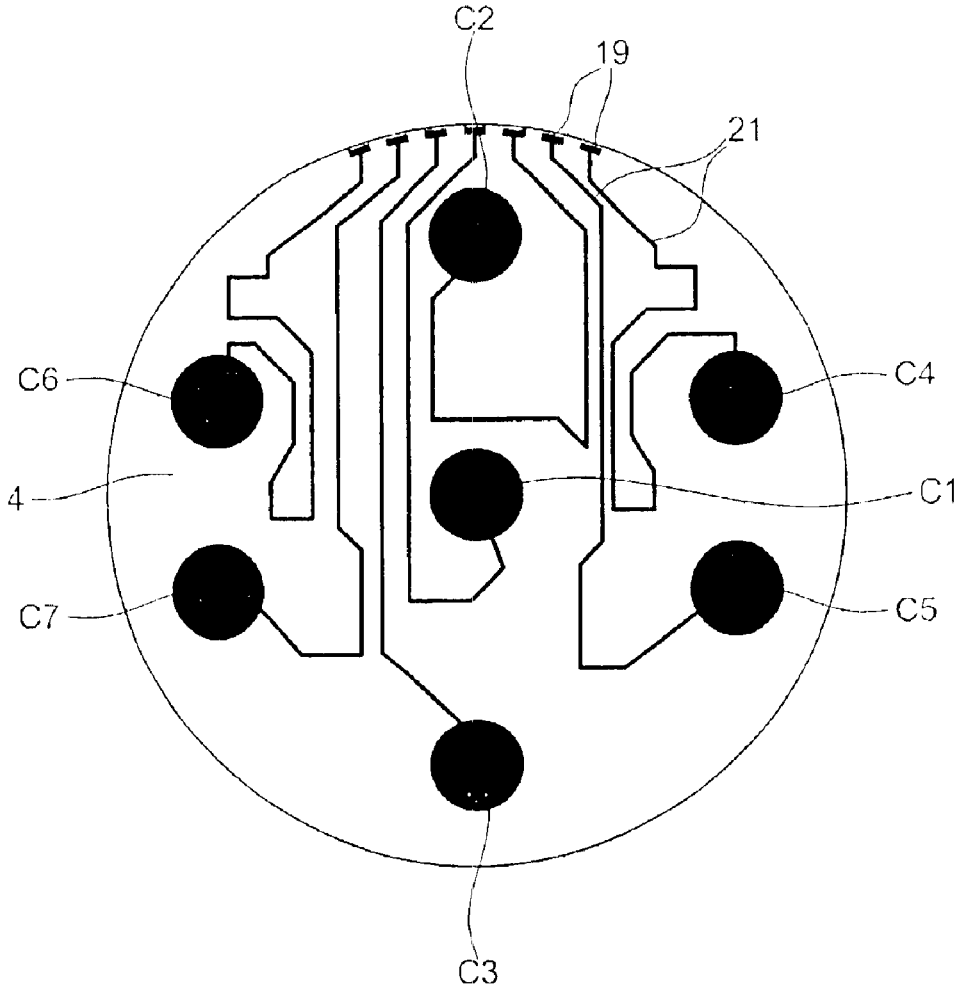
FIG. 3 shows the arrangement of the sensitive pads of capacitive sensors on an inner face of the watch crystal, and connecting wires of each pad for the manual control device according to the invention.

As can be seen in FIG. 3, sensitive pads C1 to C7 arranged on the inner face of crystal 4 are each connected by a transparent conductive wire 21 to the terminals of a connector 19. The length of all the conductive wires, as well as their width, can be identical. Connector 19 allows wires 21 to be connected to the electronic circuit. Thus, the conductive connection of each sensitive pad of sensors C1 to C7 to the electronic circuit has an equivalent resistive value so as to guarantee equivalent impedance for each non-activated sensor.

Since case 3, 3' is preferably metallic (FIGS. 1 and 2), each sensor C1 to C7 includes a parasitic capacitor defined by each sensitive pad and case 3, 3' that is connected to the negative pole of energy source 15. All the parasitic capacitors have a substantially equal capacitive value, for example 6.5 pF.

When watch 1 is worn on a user's wrist, the back cover of metallic case 3' comes into contact with the wrist to connect the user's body to the negative pole of the energy source. By placing a finger on the crystal in a determined zone of a sensitive pad of a sensor to be activated, a capacitor is generated between the sensitive pad and the user's finger. The capacitive value of the capacitor generated depends on the position and contact surface of finger 20 on crystal 4 facing the sensitive pad of the sensor to be activated. In this manner, a capacitor with variable capacitive value is connected in parallel with a corresponding parasitic capacitor.

Electronic circuit 14 will thus measure the capacitive value of each sensor to determine whether a sensor is being activated. If the sensor is not being activated, said electronic circuit only measures the capacitive value of the parasitic capacitor. However, when the sensor is being activated by finger 20 in proximity to the sensitive pad of the sensor, the total capacitive value is greater than a threshold value determined by the electronic circuit in order to control the execution of a specific function. The manual control device will be described in more detail with reference to FIG. 5.

It is clear that the sensors may also be of the resistive type with touch sensitive pads placed on the external face of the crystal, but in this case the sensitive pads are likely to wear out very quickly when the manual control device is used. The sensitive pads of the sensors are connected to the electronic circuit by insulated conductive wires. These conductive wires are preferably placed on an inner face of the watch crystal with conductive passages through the crystal for connecting the sensitive pads.

For the sake of saving power consumption, the manual control device is in a standby mode when it is not being used, as well as liquid crystal displays 5, 6. The sensors are thus made inactive in this standby mode, and the watch only provides the time indication. It is only by pressing on switch-on means, such as push-button 9, that said device becomes operational. In this operating mode, hands 7 are driven by motor 17 so as to occupy a position that does not disrupt the display of data on each display. A first hand can occupy a position close to the 9 o'clock indication, whereas a second hand can occupy a position close to the 3 o'clock indication. Once the device is no longer being used, for example after a determined period of inactivity, the device is automatically placed in the standby mode by electronic circuit 14. At this moment, hands 7 are returned to their time indicating position in a manner well known to those skilled in this technical field. A counter of a time-keeping circuit that is not shown, can for example count the time during which the device operates in order to control motor 17 so as to return the hands to their initial time indicating position.

In the embodiment described hereinbefore, the manual control device is placed in an operating mode by pressing on push-button 9. Nonetheless, one could envisage placing the device in operating mode by activating at least one of sensors C1 to C7 during a determined period. However, in this case, a problem may arise if the watch is in a particularly damp environment, since the sensors are likely to be continually activated by the presence of water on crystal 4 of watch 1. Consequently, wasteful use of energy is likely to run down the battery or accumulator of the watch very quickly.

Figure 4A:
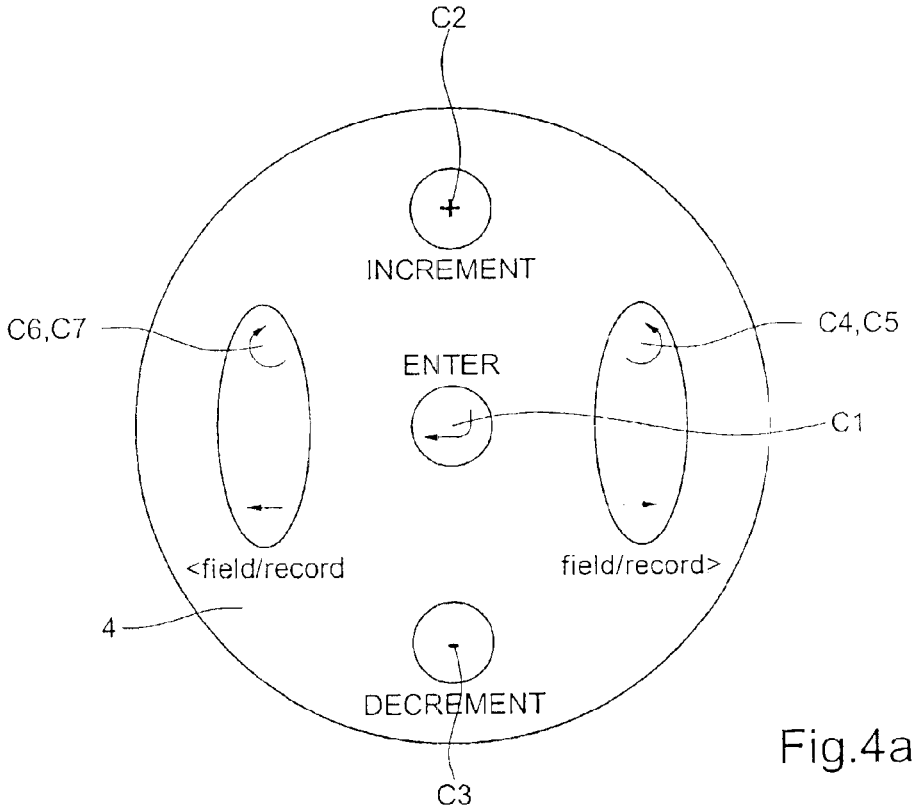
FIGS. 4*a* and 4*b* show schematically in two sensor configuration modes, the location of the sensors on the inner face of the watch crystal, and their functions for the manual control device according to the invention.
Figure 4B:
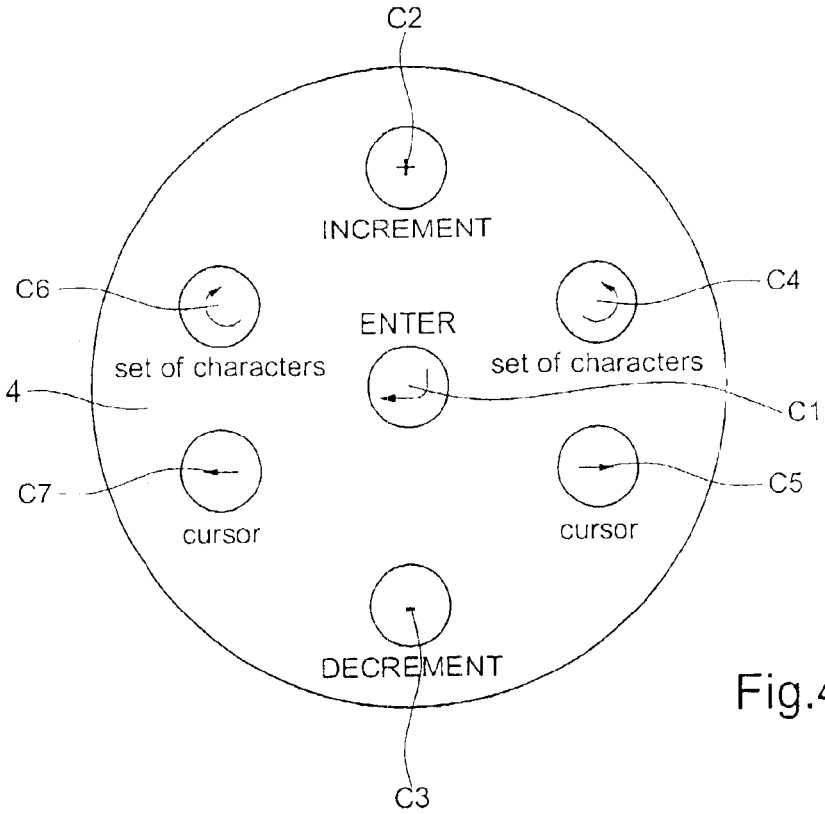

FIGS. 4*a* and 4*b* show the functions of the sensors in the first and second modes selected by the electronic circuit. It is to be noted that in the first selected mode, the electronic circuit executes a same function when one or the other of the third or fourth sensors C4 to C7 is activated. In the second selected mode, the electronic circuit executes a different specific function for each sensor activated. However, in certain menu or data entry selection steps, certain sensors might not command the electronic circuit to execute any function.

Passage from the first to the second mode can be controlled by activating at least one of the seven sensors.

Preferably, sensor C1 whose sensitive pad is located at the centre of the crystal can be used to command passage from the first mode to the second mode. In order to do this, the user's finger has to be placed on the crystal in a determined zone of the sensitive pad of sensor C1, and held in this position for a sufficient duration, for example greater than 2 seconds, for the electronic circuit to interpret the passage from first to second mode.

As indicated hereinbefore, the sensors in the first mode are used to execute menu or various diary record selecting or consulting functions, while the sensors in the second mode are used to compose texts, notes, addresses or various messages using sets of characters to be selected.

With reference to FIG. 4*a*, the sensor C1 is used particularly to control entry into a selected menu as soon as the manual control device is in an operating mode. The menu to be selected appears on the liquid crystal displays. The choice of a menu to be selected is made by third or fourth sensors C4 to C7. When one of third sensors C4, C5 is activated by a user's finger, the different menus appear successively on the liquid crystal displays in a determined ascending order. Conversely, when one of the four sensors C6, C7 is activated by the finger, the different menus appear successively on the displays in a determined descending order. In the choice of a menu from the diary (notes, addresses, diary, transmission, settings), second sensors C2 and C3 do not supply any instruction.

Once the desired menu appears on the displays, sensor C1 can be activated to enter the menu in question. In the case of the diary menu, an application of pressure on the third or fourth sensors C4 to C7 will cause the calendar to scroll down day by day in an ascending direction (increment), with one of the third sensors C4, C5 or in a descending direction (decrement) with one of fourth sensors C6, C7. Second sensors C2 and C3 are used to make the calendar scroll down month by month. When sensor C2 is activated, the calendar goes forward month by month, whereas when sensor C3 is activated, the calendar goes backward month by month.

A short application of pressure on sensor C1 will confirm the desired day. Different diary record fields can be consulted by activating sensors C4 to C7 in one direction or another.

With reference to FIG. 4*b*, sensor C1 can be activated during a determined period to enter a diary record field editing mode, for example by keeping the finger placed on the crystal facing the sensitive pad of sensor C1 for 2 seconds. From this moment, the pairs of sensors C4 to C7 are separated and thus each sensor will control the electronic circuit to execute a different specific function.

Sensors C4 and C6 will be used to choose a set of characters in one direction or in the opposite direction. Sensors C2 and C3 will be used to cause, for example, alphanumerical characters to scroll down in an ascending or descending order. Sensors C5 and C7 will be used to move a cursor in the edited field on one of the displays in an ascending or descending order. Finally, an application of pressure on sensor C1 will end edition and storage of the field.

It is of course evident that the sensors of the manual control device can be configured differently from the foregoing description. The object of the control device is to provide a reduced number of easy to manipulate sensors for executing various functions of an electronic watch.

Figure 5:
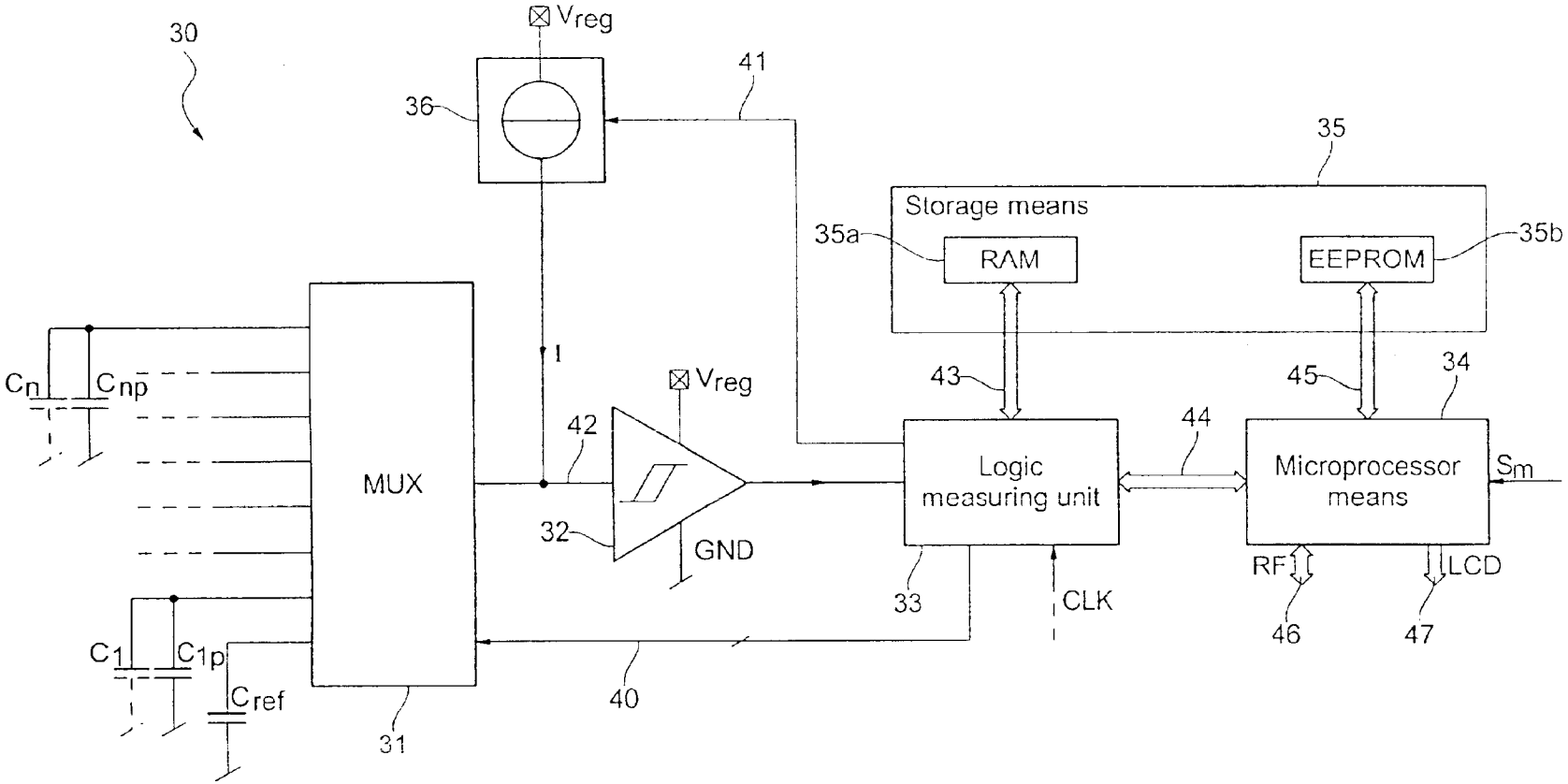
FIG. 5 shows the various electronic elements of the manual control device according to the invention.

The electronic components of manual control device 30 will be described hereinafter with reference to FIG. 5. The parts of the electronic circuit, which are known to those skilled in the art in this technical field, are only briefly explained.

Manual control device 30 is formed of different capacitive type sensors C1 to C7, whose sensitive pads are arranged on the inner face of the crystal, as well as electronic circuit 31 to 36 for processing measuring signals supplied by the different sensors.

The electronic circuit includes first of all a multiplexer 31, to the input of which are connected all of sensors C1 to Cn with their parasitic capacitor C1*p* to Cnp, and a voltage controlled oscillator 32, 36 connected to the output of the multiplexer. The number n of sensors is preferably equal to 7 in the manual control device of a diary watch. The multiplexer has the task of successively and periodically connecting each sensor to the input of the oscillator as a function of binary control words 40 supplied by a logic measuring unit 33 that follows the oscillator.

Since the oscillator is an RC type oscillator, the capacitive value of each sensor connected to the oscillator will be used to determine the oscillation frequency. This frequency is thus proportional to the reverse of the total capacitance value. Thus, without the action of a finger on a sensor connected to the oscillator, the frequency of said oscillator is only determined as a function of the capacitive value of parasitic capacitor C1*p* to Cnp. However, when a finger activates one of the sensors connected to the oscillator, the total capacitive value of the sensor is greater than that solely of the parasitic capacitor. This has the effect of lowering the frequency of the oscillator such that the logic measuring unit determines this oscillator frequency variation for the execution of a specific function.

The oscillator is essentially formed of a flip-flop 32 and a programmable current source 36. The flip-flop and the current source are connected to a terminal Vreg of a stable regulated supply voltage that can be fixed for example at 2.1 volts. Current source 36 supplies a charge current I to the capacitor connected to input 42 of the oscillator until the voltage level of the capacitor reaches a high threshold trigger voltage of flip-flop 32. Current source 36 supplies a discharge current I to the capacitor connected to input 42 of the oscillator until the capacitor voltage level drops to a low trigger threshold voltage of the flip-flop. The way in which a charge and discharge current are produced as a function of the output signals from flip-flop 32 are well known to those skilled in this technical field without it being necessary to describe current source 36 in more detail.

The object of such a current source 36 connected to terminal Vreg of a regulated supply voltage, is to produce a constant current over the entire capacitor charge and discharge range. The capacitor charge and discharge signals are thus triangular shaped signals, whereas the flip-flop output signals are signals with substantially rectangular shaped pulses.

Logic measuring unit 33 receives the rectangular shaped pulse signals in order to determine the frequency of said signals. Depending on the flip-flop output signals, logic unit 33 sends a control signal 41 to the current source to carry out switching between the capacitor charge current and the discharge current.

Logic unit 33 includes a pulse counter which is responsible for counting the number of pulses of the output signal from flip-flop 32 in a counting time window. This counting window is defined by a clock signal CLK provided by a frequency divider of the oscillator of the watch time-keeping circuit. The pulse counted binary number, for example defined over 8 bits, will be used by the measuring logic unit to determine whether the sensor connected to the oscillator is being activated or not activated by comparison to a threshold value provided.

According to a non-limiting numerical example, if the oscillation frequency is of the order of 30 kHz, the duration of the counting window may be 8 ms (240 pulses counted), which corresponds to a CLK frequency of 125 Hz. Thus, the maximum number of pulses counted is less than 255 which corresponds to the maximum number of an 8-bit binary word. However, this counting window can be adapted to allow counting over a longer period so as to ensure that one of the sensors has been activated.

When the manual control device is placed in the operating mode, measuring logic unit 33 will send control signals 40 to the multiplexer to start an initialisation phase. In this phase, all of sensors C1 to Cn are successively connected to the input of the oscillator to carry the frequency measurement of the oscillator signals during a period determined by the logic unit. The result of the frequency measured for each sensor, which corresponds to the frequency determined by parasitic capacitor C1*n* to Cnp, is sent by bus 43 to be stored in storage means 35, particularly in a volatile RAM memory 35*a*. Thus, during use of the manual control device, the determined frequency of each sensor will be able to be compared to the stored value to find out whether the sensor is being activated or not.

The embodiment of manual control device 30 also provides for a reference capacitor Cref to be connected to the input of multiplexer 31. The capacitive value of this capacitor (for example 7.5 pF) is preferably identical to or slightly greater than the value of a parasitic capacitor. This capacitor can be a discrete component placed inside the watch. Thus, reference capacitor Cref and the other sensors will be successively connected to the oscillator.

This capacitor Cref, whose capacitive value is well defined, will essentially be used to adjust the value of the charge and discharge currents of current source 36. Moreover, it allows logic unit 33 to carry out a measurement of the oscillator frequency drift, for example due to temperature variation.

In a normal operating mode, the logic unit will transmit binary data via bus 44 to microprocessor means 34 linked to storage means 35 for recognising the specific function to be activated from the activated sensor. The microprocessor means will also carry out write recognition using diary function software. These microprocessor means will send edited data to be stored in a non volatile EEPROM memory 35*b* as a function of the binary data received by bus 44.

Microprocessor means 34 will send control signals LCD via bus 47 to the liquid crystal display drive device so that they display the desired data. Moreover, data can be received from RF modules via bus 46 or be sent to said RF module for transmission of the data signals to a computer station or to another watch. A control signal Sm applied to the microprocessor means will allow the manual control device to pass from a standby mode to an operating mode. This signal Sm is for example generated by action on the push-button.

It is to be noted that microprocessor means 34 are capable of reading data stored in registers of measuring logic unit 33 that are not shown, or sending configuration parameters to said logic unit. The capacitive value of capacitor Cref is for example stored in one of the logic unit registers to be read by the microprocessor means.

For complementary technical details concerning the electronic circuit, the reader can refer to European Patent document No. 0 838 737 by the same Applicant which is cited as reference.

From the description that has just been made of multiple variants of the manual control device for an electronic watch can be conceived by those skilled in the art without departing from the scope of the invention defined by the claims. This device can be used in any portable instrument with a wristband.

What is claimed is:

1. A manual control device for executing functions particularly for an electronic watch including, in a case closed by a crystal, a time-keeping circuit and/or a watch movement powered by an energy source, and at least one liquid crystal display for displaying data, said device including:

a determined number of sensors wherein one touch sensitive pad of each sensor is arranged on an internal or external face of the watch crystal, each sensor being able to be activated by a user's finger placed on the crystal In a determined zone of the corresponding sensitive pad of the sensor in order to control the execution of a specific function, and an electronic circuit for processing measuring signals provided by the sensors for carrying out a specific instruction from an activated sensor, the electronic circuit providing control signals to the liquid crystal display of the watch to display data corresponding to the activated sensor, wherein in a first mode selected by the electronic circuit, at least two sensors are grouped such that they are activated together and the electronic circuit executes the same operation when a finger is placed on the crystal in a determined zone of the sensitive pad of one sensor of the other grouped sensor whereas in a second mode selected by the electronic circuit, each sensor activated by itself and by the finger provides measuring signals to the electronic circuit for executing a specific operation different for each sensor.

2. The device according to claim 1, wherein the sensitive pads of the sensors are connected to the electronic circuit, via a connector, each by a conductive wire, the length of all the conductive wires being identical.

3. The device according to claim 1, wherein the sensitive pads with no direct contact between them are distributed on the internal or external face of the crystal so as to allow a finger to be able to be placed on a single sensitive pad of a sensor to be activated without influencing the other sensors.

4. The device according to claim 3, wherein the sensitive pads are each separated by a distance greater than or equal to the dimension of a sensitive pad, and wherein the number of sensors is less than 10, preferably equal to 7.

5. The device according to claim 4 for an analogue wristwatch including a dial with the liquid crystal display and hands for indicating the time, wherein the sensitive pads of the seven sensors have an equivalent surface, wherein a first sensor has its sensitive pad arranged at the centre of the crystal, wherein two second sensors have their sensitive pad arranged at the periphery of the crystal respectively at 6 o'clock and at 12 o'clock, wherein two third sensors have their sensitive pad arranged at the periphery of the crystal around the 3 o'clock indication, and wherein two fourth sensors have their sensitive pad arranged at the periphery of the crystal around the 9 o'clock indication.

6. The device according to claim 5 for an electronic diary watch, the sensors of the device being active, when the device is in a normal operating mode, or inactive when the device is in a standby mode, the watch including switch-on means for placing the device in a normal operating mode when they are activated, wherein in the first selected mode in normal operation, the third sensors and the fourth sensors are grouped in pairs to allow diary menus, various stored records concerning addresses, notes, settings and the diary to be consulted by activating at least a third sensor or a fourth sensor, and wherein in the second selected mode, the third sensors and fourth sensors are separated to allow fields of various records to be stored to be edited using sets of characters.

7. The device according to claim 1, wherein capacitive type sensors each include a first parasitic capacitor defined by each transparent sensitive pad arranged on the internal face of the crystal and the metallic case of the watch, as well as a second parallel capacitor defined by the sensitive pad and a user's finger when the finger is placed on the crystal in a determined zone of the sensitive pad of the sensor to be activated, the total capacitive value depending upon the position and the surface of the finger placed on the crystal facing the sensitive pad.

8. The device according to claim 7, wherein electronic circuit further includes a single voltage controlled oscillator, a multiplexer for successively connecting each sensor to the oscillator, a logic measuring unit for determining the frequency of the oscillator signals which depends on the total capacitive value of each sensor connected to the oscillator, the frequency being below a threshold frequency value when a sensor is being activated by the user's finger, whereas the frequency is above the threshold frequency value when the sensor is not being activated, and microprocessor means connected to the logic measuring unit for recognising the function to be executed from an activated sensor.

9. The device according to claim 8, wherein the voltage controlled oscillator includes a flip-flop and a programmable current source for supplying a charge and discharge current to the capacitor of a sensor connected to the input of the flip-flop as a function of the output signals of the flip-flop.

10. The device according to claim 8, wherein a reference capacitor and the other sensors are successively connected to the oscillator via the multiplexer to allow the oscillator frequency to be calibrated with respect to a stored reference frequency value.

11. The device according to claim 1, wherein marks are placed on the internal face of the crystal in order to indicate the location of each sensitive sensor pad and/or a function for each sensor.

12. An electronic watch including, in a case closed by a crystal, a time-keeping circuit and/or a watch movement powered by an energy source, and at least one liquid crystal display for displaying data, and a manual control device according to claim 1, wherein the liquid crystal display and the sensitive pads of the sensors are arranged so as to make data displayed on the display visible when certain sensors are activated by a user's finger.

13. The watch according to claim 12 of analogue type including a dial with two liquid crystal displays and hands for indicating the time, wherein icons for identifying a function or an operation to be carried out are arranged on the dial at determined positions around each liquid crystal display, and wherein the electronic sensor measuring signal processing circuit provides control signals to each display as a function of the activated sensors such that at least one pointer of each display designates one of the icons to indicate, when the device is operating, a function or an operation in progress.

14. The watch according to claim 13, wherein it includes means for switching on the manual control device allowing the device to pass from a standby mode to an operating mode when they are activated, and wherein the hands are moved to determined positions in the operating mode of the device to avoid concealing the data displayed on each liquid crystal display.

15. A manual control device for executing functions particularly for an electronic watch including, in a case closed by a crystal, a time-keeping circuit and/or a watch movement powered by an energy source, and at least one liquid crystal display for displaying data, said device including:

a determined number of sensors wherein one touch sensitive pad of each sensor is arranged on an internal or external face of the watch crystal, each sensor being able to be activated by a user's finger placed on the crystal in a determined zone of the corresponding sensitive pad of the sensor in order to control the execution of a specific function, and an electronic circuit for processing measuring signals provided by the sensors for carrying out a specific instruction from an activated sensor, the electronic circuit providing control signals to the liquid crystal display of the watch to display data corresponding to the activated sensor, wherein in a first mode selected by electronic circuit at least two sensors are grouped such that they are activated together and the electronic circuit executes he same operation when a finger is placed on the crystal in a determined zone of the sensitive pad of one of two sensors or the other whereas in a second mode selected by the electronic circuit, each sensor activated by it self and by the finger provides measuring signals to the electronic circuit for executing a specific operation different for each sensor, wherein the sensitive pads are each separated by a distance greater than or equal to the dimension of a sensitive pad, and wherein the number of sensors is less than 10.

16. The manual control device according to claim 15, wherein the number of sensors is 7.

* * * * *